US011145264B2

(12) United States Patent
Hwang et al.

(10) Patent No.: US 11,145,264 B2
(45) Date of Patent: Oct. 12, 2021

(54) METHOD OF DRIVING A DISPLAY PANEL AND A DISPLAY APPARATUS FOR PERFORMING THE SAME

(71) Applicant: SAMSUNG DISPLAY CO., LTD., Yongin-si (KR)

(72) Inventors: Hyun Sik Hwang, Hwaseong-si (KR); Daecheol Kim, Hwaseong-si (KR); Yoongu Kim, Seoul (KR); Bongim Park, Hwaseong-si (KR); Ik Hyun Ahn, Hwaseong-si (KR); Woojoo Lee, Seoul (KR); Tae-Jong Jun, Suwon-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 22 days.

(21) Appl. No.: 16/724,497

(22) Filed: Dec. 23, 2019

(65) Prior Publication Data

US 2020/0143761 A1 May 7, 2020

Related U.S. Application Data

(62) Division of application No. 15/403,584, filed on Jan. 11, 2017, now Pat. No. 10,515,598.

(30) Foreign Application Priority Data

Apr. 4, 2016 (KR) ..... 10-2016-0041266

(51) Int. Cl.

| | |
|---|---|
| ***G09G 3/36*** | (2006.01) |
| ***G09G 3/20*** | (2006.01) |
| ***G09G 5/06*** | (2006.01) |

(52) U.S. Cl.

CPC ..... *G09G 3/3607* (2013.01); *G09G 3/20* (2013.01); *G09G 3/3614* (2013.01); *G09G 5/06* (2013.01);

(Continued)

(58) Field of Classification Search

CPC ..... G09G 3/3607; G09G 3/20; G09G 5/06; G09G 2310/068; G09G 2320/0233; G09G 2340/16; G09G 2360/18

See application file for complete search history.

(56) References Cited

U.S. PATENT DOCUMENTS 6,333,751 B1 * 12/2001 Torii ..... G09G 5/005 345/213

6,566,643 B2 5/2003 Morita (Continued)

FOREIGN PATENT DOCUMENTS

CN 001896813 1/2007
CN 102362307 2/2012

(Continued)

OTHER PUBLICATIONS

Chinese Office Action dated Aug. 21, 2020 from the Chinese Patent Office issued in corresponding Chinese Patent Application No. 201710205866.X.

(Continued)

*Primary Examiner* — Antonio Xavier

(74) *Attorney, Agent, or Firm* — F. Chau & Associates, LLC

(57) ABSTRACT

A method of driving a display panel includes determining a present polarity of a pixel data signal of a present frame, generating a first compensated grayscale of the pixel data signal of the present frame using a pixel data signal of a previous frame, the pixel data signal of the present frame, and the present polarity, and displaying an image using the first compensated grayscale. The first compensated grayscale varies according to the present polarity.

13 Claims, 10 Drawing Sheets

(52) U.S. Cl.
CPC ..... *G09G 2310/068* (2013.01); *G09G 2320/0233* (2013.01); *G09G 2320/0252* (2013.01); *G09G 2340/16* (2013.01); *G09G 2360/18* (2013.01)

(56) References Cited

U.S. PATENT DOCUMENTS

| | | | | |
|---|---|---|---|---|
| 7,786,966 | B2 | 8/2010 | Nakanishi et al. | |
| 7,839,375 | B2 | 11/2010 | Lee et al. | |
| 9,653,030 | B2 | 5/2017 | Zheng | |
| 10,515,598 | B2 * | 12/2019 | Hwang | G09G 3/3607 |
| 2002/0093475 | A1 | 7/2002 | Hashimoto | |
| 2005/0104877 | A1 * | 5/2005 | Nakamura | G06F 3/0488 345/207 |
| 2005/0253799 | A1 * | 11/2005 | Kamio | G09G 3/3666 345/103 |
| 2007/0152942 | A1 | 7/2007 | Yamagishi | |
| 2007/0296669 | A1 * | 12/2007 | Jeon | G09G 3/3648 345/89 |
| 2009/0174638 | A1 * | 7/2009 | Brown Elliott | G09G 3/2081 345/88 |
| 2009/0267884 | A1 * | 10/2009 | Takahashi | G09G 3/3648 345/96 |
| 2010/0207959 | A1 | 8/2010 | Qi et al. | |
| 2011/0298774 | A1 | 12/2011 | Yamada et al. | |
| 2012/0113166 | A1 * | 5/2012 | Murakami | G09G 3/342 345/690 |
| 2012/0169720 | A1 | 7/2012 | Moh et al. | |
| 2014/0085276 | A1 * | 3/2014 | Jang | G09G 3/20 345/204 |
| 2014/0085287 | A1 * | 3/2014 | Kim | G09G 3/3614 345/212 |
| 2014/0270562 | A1 * | 9/2014 | Neal | G06T 7/20 382/254 |
| 2014/0320509 | A1 * | 10/2014 | Chen | G06T 1/20 345/501 |
| 2015/0243234 | A1 * | 8/2015 | Bloks | G09G 3/3618 345/96 |
| 2015/0279294 | A1 * | 10/2015 | Inada | G09G 3/3614 345/693 |
| 2017/0154561 | A1 | 6/2017 | He et al. | |
| 2017/0287418 | A1 | 10/2017 | Hwang et al. | |
| 2018/0190220 | A1 * | 7/2018 | Yu | G09G 3/3614 |

FOREIGN PATENT DOCUMENTS

| | | |
|---|---|---|
| CN | 104464672 | 3/2015 |
| CN | 105047162 | 11/2015 |
| JP | 2002-023709 | 1/2002 |
| KR | 1020140000462 | 1/2014 |

OTHER PUBLICATIONS

Search Report dated Aug. 30, 2017 for European Patent Office in corresponding European Patent Application No. 17164271.3.

* cited by examiner

METHOD OF DRIVING A DISPLAY PANEL AND A DISPLAY APPARATUS FOR PERFORMING THE SAME

CROSS-REFERENCE TO RELATED APPLICATIONS

This application is a divisional of U.S. patent application Ser. No. 15/403,584 filed on Jan. 11, 2017, which claims priority under 35 U.S.C. § 119 to Korean Patent Application No. 10-2016-0041266, filed on Apr. 4, 2016 in the Korean Intellectual Property Office (KIPO), the disclosures of which are incorporated by reference herein in their entireties.

TECHNICAL FIELD

Exemplary embodiments of the inventive concept relate to a method of driving a display panel and a display apparatus for performing the method.

DISCUSSION OF RELATED ART

Generally, a liquid crystal display (LCD) apparatus includes a first substrate including a pixel electrode, a second substrate including a common electrode, and a liquid crystal layer disposed between the first and second substrates. An electric field is generated by voltages applied to the pixel electrode and the common electrode. By adjusting the intensity of the electric field, the transmittance of light passing through the liquid crystal layer may be adjusted so that an image can be displayed.

A driving frequency of a display panel may be increased to increase a display quality of a display apparatus. However, when the LCD apparatus is driven with a high driving frequency, a response of the liquid crystal may be slow. Therefore, an image displayed on the display panel of the LCD apparatus may not achieve a desired luminance.

SUMMARY

In an exemplary embodiment of the inventive concept, a method of driving a display panel includes determining a present polarity of a pixel data signal of a present frame, generating a first compensated grayscale of the pixel data signal of the present frame using a pixel data signal of a previous frame, the pixel data signal of the present frame, and the present polarity, and displaying an image using the first compensated grayscale. The first compensated grayscale varies according to the present polarity.

In an exemplary embodiment of the inventive concept, a compensated grayscale for a negative subpixel when the present polarity is negative may be less than a compensated grayscale for a positive subpixel when the present polarity is positive.

In an exemplary embodiment of the inventive concept, the first compensated grayscale is generated using a first lookup table storing the compensated grayscale for the negative subpixel and a second lookup table storing the compensated grayscale for the positive subpixel.

In an exemplary embodiment of the inventive concept, the present polarity may be determined using a pixel map that represents a structure of pixel data of the present frame, a line count and a pixel count that represent a location in the pixel map, and a polarity signal that represents polarities of all the pixel data of the present frame.

In an exemplary embodiment of the inventive concept, the method may further include determining a previous polarity of the pixel data signal of the previous frame. The first compensated grayscale may be further generated using the previous polarity. The first compensated grayscale varies according to the previous polarity and the present polarity.

In an exemplary embodiment of the inventive concept, the previous polarity may be determined using a pixel map that represents a structure of pixel data of the present frame, a line count and a pixel count that represent a location in the pixel map, a polarity signal that represents polarities of all the pixel data of the present frame, and an inverting mode signal that represents an inverting mode of all the pixel data of the present frame.

In an exemplary embodiment of the inventive concept, a compensated grayscale for a negative subpixel when the present polarity is negative may be less than a compensated grayscale for a positive subpixel when the present polarity is positive.

In an exemplary embodiment of the inventive concept, a negative to negative compensated grayscale is generated when the previous polarity is negative and the present polarity is negative. A positive to negative compensated grayscale is generated when the previous polarity is positive and the present polarity is negative. The negative to negative compensated grayscale is less than the positive to negative compensated grayscale.

In an exemplary embodiment of the inventive concept, a negative to positive compensated grayscale is generated when the previous polarity is negative and the present polarity is positive. A positive to positive compensated grayscale is generated when the previous polarity is positive and the present polarity is positive. The negative to positive compensated grayscale is greater than the positive to positive compensated grayscale.

In an exemplary embodiment of the inventive concept, the first compensated grayscale may be generated using a first lookup table storing the negative to negative compensated grayscale, a second lookup table storing the positive to negative compensated grayscale, a third lookup table storing the negative to positive compensated grayscale, and a fourth lookup table storing the positive to positive compensated grayscale.

In an exemplary embodiment of the inventive concept, the method may further include merging the present polarity with the pixel data signal of the present frame to generate a merged signal of the present frame and extracting the present polarity from the merged signal of the present frame.

In an exemplary embodiment of the inventive concept, a display apparatus includes a pixel polarity determining part, a grayscale compensating part, and a display panel. The pixel polarity determining part is configured to determine a present polarity of a pixel data signal of a present frame. The grayscale compensating part is configured to generate a first compensated grayscale of the pixel data signal of the present frame by using a pixel data signal of a previous frame, the pixel data signal of the present frame, and the present polarity. The first compensated grayscale varies according to the present polarity. The display panel is configured to display an image using the first compensated grayscale.

In an exemplary embodiment of the inventive concept, the display apparatus may further include a data buffer and a memory. The data buffer may be configured to buffer the pixel data signal of the present frame and to output the pixel data signal of the present frame. The memory may be configured to delay the pixel data signal of the present frame to generate the pixel data signal of the previous frame and to output the pixel data signal of the previous frame to the grayscale compensating part.

In an exemplary embodiment of the inventive concept, the grayscale compensating part may be configured to generate a compensated grayscale for a negative subpixel when the present polarity is negative and a compensated grayscale for a positive subpixel when the present polarity is positive. The compensated grayscale for the negative subpixel is less than the compensated grayscale for the positive subpixel.

In an exemplary embodiment of the inventive concept, the grayscale compensating part may include a first lookup table storing the compensated grayscale for the negative subpixel and a second lookup table storing the compensated grayscale for the positive subpixel.

In an exemplary embodiment of the inventive concept, the pixel polarity determining part may be configured to determine the present polarity using a pixel map that represents a structure of pixel data of the present frame, a line count and a pixel count that represent a location in the pixel map, and a polarity signal that represents polarities of all the pixel data of the present frame.

In an exemplary embodiment of the inventive concept, the pixel polarity determining part may be configured to determine a previous polarity. The grayscale compensating part may be further configured to generate the first compensated grayscale using the previous polarity. The first compensated grayscale varies according to the previous polarity and the present polarity.

In an exemplary embodiment of the inventive concept, the grayscale compensating part may be configured to generate a compensated grayscale for a negative subpixel when the present polarity is negative and a compensated grayscale for a positive subpixel when the present polarity is positive. The compensated grayscale for the negative subpixel is less than the compensated grayscale for the positive subpixel. The grayscale compensating part may be configured to generate a negative to negative compensated grayscale when the previous polarity is negative and the present polarity is negative and a positive to negative compensated grayscale when the previous polarity is positive and the present polarity is negative. The negative to negative compensated grayscale is less than the positive to negative compensated grayscale. The grayscale compensating part may be configured to generate a negative to positive compensated grayscale when the previous polarity is negative and the present polarity is positive and a positive to positive compensated grayscale when the previous polarity is positive and the present polarity is positive. The negative to positive compensated grayscale is greater than the positive to positive compensated grayscale.

In an exemplary embodiment of the inventive concept, the grayscale compensating part may include a first lookup table storing the negative to negative compensated grayscale, a second lookup table storing the positive to negative compensated grayscale, a third lookup table storing the negative to positive compensated grayscale, and a fourth lookup table storing the positive to positive compensated grayscale.

In an exemplary embodiment of the inventive concept, the pixel polarity determining part may be configured to output the present polarity to a data buffer. The data buffer may be configured to merge the present polarity with the pixel data signal of the present frame to generate a merged signal of the present frame. The grayscale compensating part may be configured to extract the present polarity from the merged signal of the present frame.

In an exemplary embodiment of the inventive concept, a method of driving a display panel includes determining a present polarity of a pixel data signal of a present frame, merging the present polarity with the pixel data signal of the present frame to generate a first merged signal of the present frame, delaying the first merged signal to generate a second merged signal of a previous frame, extracting the present polarity from the first merged signal, extracting a previous polarity of a pixel data signal of the previous frame from the second merged signal, and generating a compensated grayscale using the pixel data signal of the previous frame, the pixel data signal of the present frame, the previous polarity, and the present polarity. The compensated grayscale varies according to the previous polarity and the present polarity.

BRIEF DESCRIPTION OF THE DRAWINGS

The above and other features of the inventive concept will become more apparent by describing in detail exemplary embodiments thereof with reference to the accompanying drawings.

DETAILED DESCRIPTION OF THE EMBODIMENTS

Figure 1:
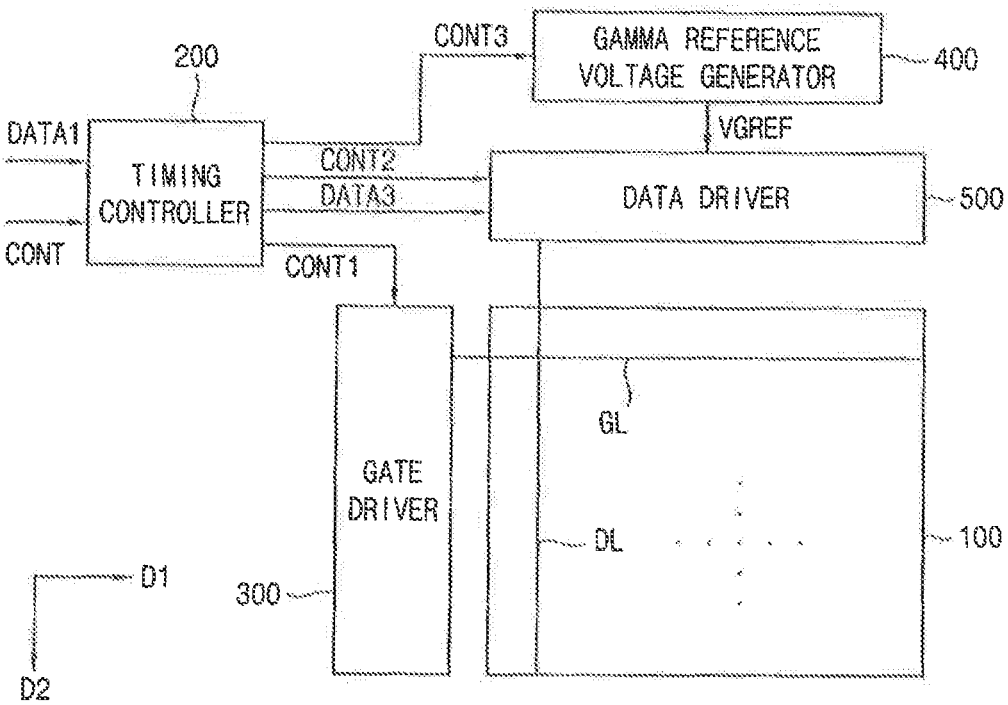
FIG. 1 is a block diagram illustrating a display apparatus according to an exemplary embodiment of the inventive concept.

Exemplary embodiments of the inventive concept will be described more fully hereinafter with reference to the accompanying drawings. Like reference numerals may refer to like elements throughout the accompanying drawings.

Exemplary embodiments of the inventive concept provide a method of driving a display panel. The method includes generating a compensated grayscale that varies according to a polarity of a present frame to increase a display quality of the display panel.

Exemplary embodiments of the inventive concept also provide a display apparatus for performing the above-mentioned method.

FIG. 1 is a block diagram illustrating a display apparatus according to an exemplary embodiment of the inventive concept.

Referring to FIG. 1, the display apparatus includes a display panel 100 and a panel driver. The panel driver includes a timing controller 200, a gate driver 300, a gamma reference voltage generator 400, and a data driver 500.

The display panel 100 has a display region on which an image is displayed and a peripheral region adjacent to the display region.

The display panel 100 includes a plurality of gate lines GL, a plurality of data lines DL, and a plurality of subpixels connected to the gate lines GL, and the data lines DL. The gate lines GL extend in a first direction D1 and the data lines DL extend in a second direction D2 that crosses the first direction D1.

Each subpixel includes a switching element, a liquid crystal capacitor, and a storage capacitor. The liquid crystal capacitor and the storage capacitor are electrically connected to the switching element. The plurality of subpixels may be disposed in a matrix form.

The timing controller 200 receives input image data DATA1 and an input control signal CONT from an external apparatus. The input image data DATA1 may include red image data, green image data, and blue image data. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3, and a data signal DATA3 based on the input image data DATA1 and the input control signal CONT.

The timing controller 200 generates the first control signal CONT1 based on the input control signal CONT, and outputs the first control signal CONT1 to the gate driver 300. The first control signal CONT1 may control an operation of the gate driver 300. The first control signal CONT1 may further include a vertical start signal and a gate clock signal.

The timing controller 200 generates the second control signal CONT2 based on the input control signal CONT, and outputs the second control signal CONT2 to the data driver 500. The second control signal CONT2 may control an operation of the data driver 500. The second control signal CONT2 may include a horizontal start signal and a load signal.

The timing controller 200 generates the data signal DATA3 based on the input image data DATA1. The timing controller 200 outputs the data signal DATA3 to the data driver 500.

The timing controller 200 may perform an overdriving method. In the overdriving method, a grayscale of pixel data of a present frame may be compensated based on pixel data of a previous frame and the pixel data of the present frame. For example, when the difference between the grayscale of the pixel data of the previous frame and the grayscale of the pixel data of the present frame is relatively large, the timing controller 200 may compensate the grayscale of the pixel data of the present frame to be higher than a target grayscale. The overdriving method of the timing controller 200 will be explained in detail below with reference to FIGS. 2, 3A, and 3B.

The timing controller 200 generates the third control signal CONT3 based on the input control signal CONT, and outputs the third control signal CONT3 to the gamma reference voltage generator 400. The third control signal CONT3 may control an operation of the gamma reference voltage generator 400

The structure and operation of the timing controller 200 will be explained in detail below with reference to FIGS. 2 to 9.

In response to the first control signal CONT received from the timing controller 200, the gate driver 300 generates gate signals to drive the gate lines GL. The gate driver 300 sequentially outputs the gate signals to the gate lines GL.

The gate driver 300 may be directly mounted on the display panel 100, or may be connected to the display panel 100 as a tape carrier package (TCP) type. Alternatively, the gate driver 300 may be integrated into the display panel 100.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA3.

In an exemplary embodiment of the inventive concept, the gamma reference voltage generator 400 may be disposed in the timing controller 200 or in the data driver 500.

The data driver 500 receives the second control signal CONT2 and the data signal DATA3 from the timing controller 200, and receives the gamma reference voltages VGREF from the gamma reference voltage generator 400. Using the gamma reference voltage VGREF, the data driver 500 converts the data signal DATA3 into data voltages having an analog type. The data driver 500 outputs the data voltages to the data lines DL.

The data driver 500 may be directly mounted on the display panel 100, or connected to the display panel 100 as a TCP type. Alternatively, the data driver 500 may be integrated into the display panel 100.

Figure 2:
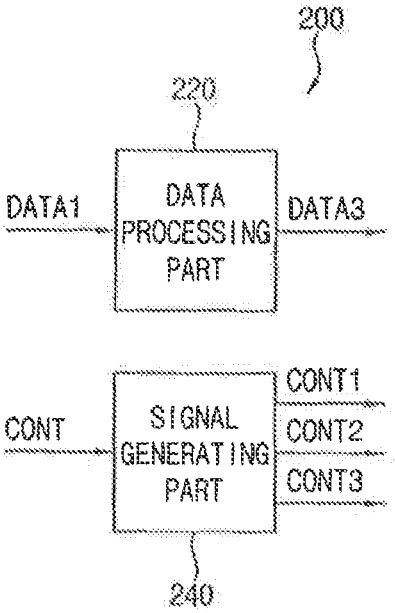
FIG. 2 is a block diagram illustrating a timing controller of FIG. 1 according to an exemplary embodiment of the inventive concept.
Figure 3A:
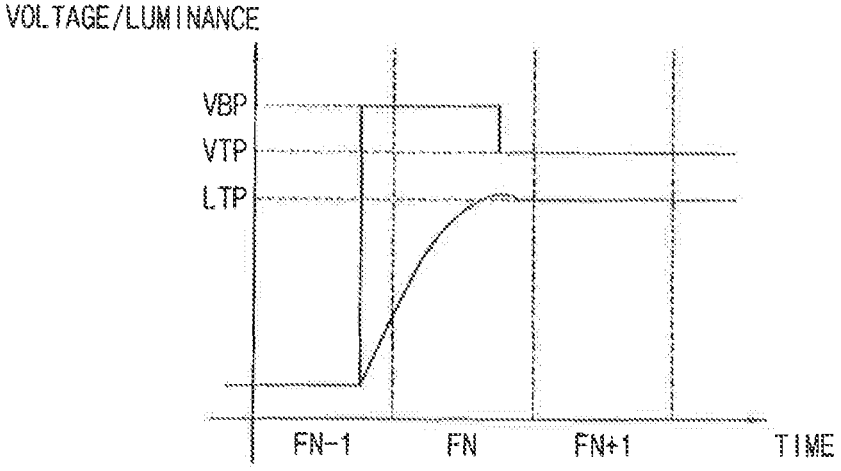
FIG. 3A is a graph illustrating an overdriving method of the timing controller of FIG. 1 in a positive polarity according to an exemplary embodiment of the inventive concept.
Figure 3B:
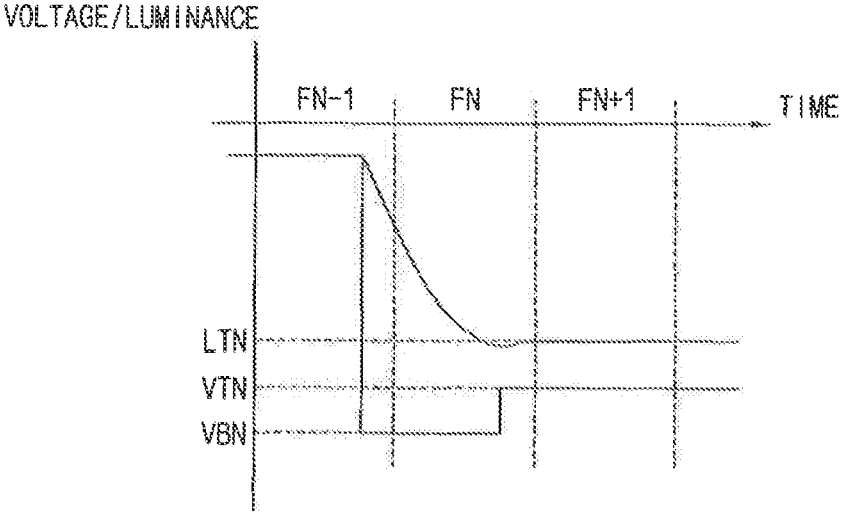
FIG. 3B is a graph illustrating an overdriving method of the timing controller of FIG. 1 in a negative polarity according to an exemplary embodiment of the inventive concept.

FIG. 2 is a block diagram illustrating the timing controller 200 of FIG. 1 according to an exemplary embodiment of the inventive concept. FIG. 3A is a graph illustrating an overdriving method of the timing controller of FIG. 1 in a positive polarity according to an exemplary embodiment of the inventive concept. FIG. 3B is a graph illustrating an overdriving method of the timing controller of FIG. 1 in a negative polarity according to an exemplary embodiment of the inventive concept.

Referring to FIGS. 1 to 3B, the timing controller 200 includes a data processing part 220 and a signal generating part 240.

The data processing part 220 compensates a grayscale of the input image data DATA1 and rearranges the input image data DATA1 to correspond to a type of the data driver 500, thereby generating the data signal DATA3.

The signal generating part 240 generates the first control signal CONT1 for controlling the operation of the gate driver 300 and outputs the first control signal CONT1 to the gate driver 300. The signal generating part 240 generates the second control signal CONT2 for controlling the operation of the data driver 500 and outputs the second control signal CONT2 to the data driver 500. The signal generating part 240 generates the third control signal CONT3 for controlling the operation of the gamma reference voltage generator 400 and outputs the third control signal CONT3 to the gamma reference voltage generator 400.

The data processing part 220 may generate a compensated grayscale of the pixel data of the present frame, based on a pixel data signal of the previous frame and a pixel data signal of the present frame.

When the difference between the grayscale of the pixel data signal of the previous frame and the grayscale of the pixel data signal of the present frame is relatively large and the response of the liquid crystal is not fast enough, the pixel may not display the desired luminance in the present frame. Thus, to achieve the desired luminance, the data processing part 220 may generate the compensated grayscale of the pixel data of the present frame based on the difference of the grayscale of the pixel data signal of the previous frame and the grayscale of the pixel data signal of the present frame.

Referring to the graphs in FIGS. 3A and 3B, the y-axis represents voltage/luminance and the x-axis represents time.

In FIG. 3A, a target luminance LTP of the present frame FN is much greater than the luminance of the previous frame FN−1. If a data voltage VTP accurately corresponding to the target grayscale is applied in the present frame FN, the pixel may display a luminance less than the target luminance LTP in the present frame FN.

In FIG. 3A, a data voltage VBP, corresponding to the compensated grayscale which is greater than the target grayscale, is applied in the present frame FN so that the pixel may display the target luminance LTP in the present frame FN. The present frame FN may be called a boosted frame.

When a target grayscale in a next frame FN+1 is substantially the same as the target grayscale in the present frame FN, overdriving may not be required in the next frame FN+1. Thus, the data signal VTP corresponding to the target grayscale may be applied to the pixel.

In FIG. 3B, a target luminance LTN of the present frame FN is much smaller than the luminance of the previous frame FN−1. If a data voltage VTN accurately corresponding to the target grayscale is applied in the present frame FN, the pixel may display a luminance greater than the target luminance LTN in the present frame IN.

In FIG. 3B, a data voltage VBN, corresponding to the compensated grayscale which is less than the target grayscale, is applied in the present frame FN so that the pixel may display the target luminance LTN in the present frame FN. The present frame IN may be called the boosted frame.

When a target grayscale in the next frame FN+1 is substantially the same as the target grayscale in the present frame FN, overdriving may not be required in the next frame FN+1. Thus, the data signal VTN corresponding to the target grayscale may be applied to the pixel.

In a conventional overdriving method, if conditions (e.g., the grayscale of the pixel data of the previous frame and the grayscale of the pixel data of the present frame) are substantially the same, the data signal VBP for overdriving in the positive polarity may be substantially the same as the data signal VBN for overdriving in the negative polarity, except for the polarity. On the other hand, according to exemplary embodiments of the inventive concept, the data signal VBP and the data signal VBN may be different, which will be described in detail below.

Figure 4:
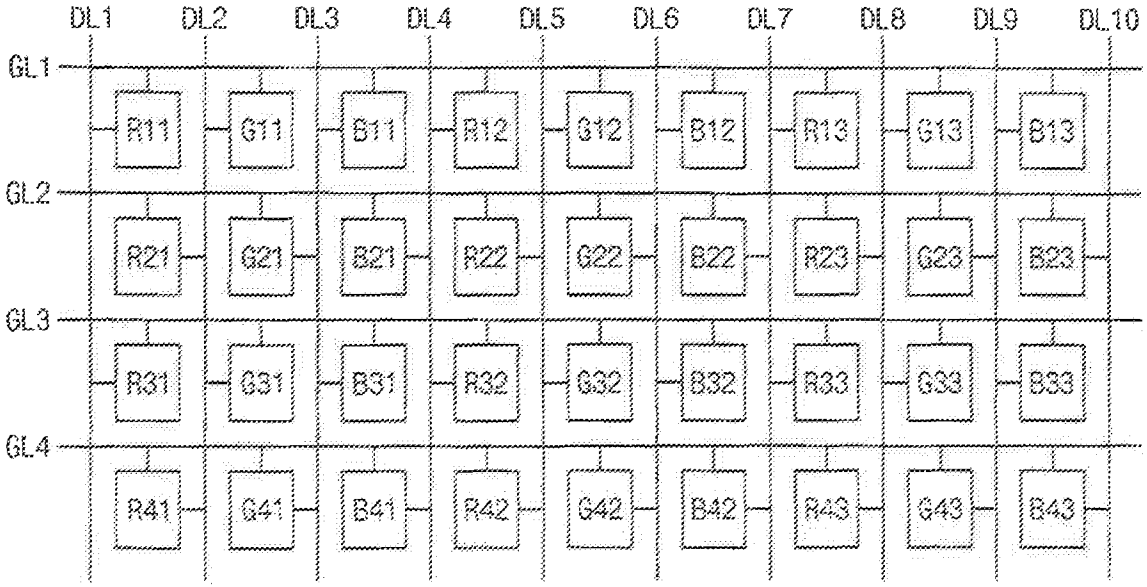
FIG. 4 is a diagram illustrating a pixel structure of the display panel of FIG. 1 according to an exemplary embodiment of the inventive concept.

FIG. 4 is a diagram illustrating a pixel structure of the display panel of FIG. 1 according to an exemplary embodiment of the inventive concept.

Referring to FIGS. 1 and 4, the display panel 100 may have an alternate pixel structure. For example, the red subpixel, the green subpixel, and the blue subpixel may be alternately disposed in a subpixel row of the display panel 100. Subpixels having the same color may be disposed in the same subpixel column of the display panel 100.

The subpixels in the subpixel row are sequentially connected to a single gate line among the gate lines GL. For example, the subpixels R11, G11, B11, R12, G12, B12, R13, G13, and B13 in a first subpixel row are sequentially connected to a first gate line GL1.

The subpixels in each subpixel column may be alternately connected to two adjacent data lines. For example, the subpixels R11, R21, R31, and R41 in a first subpixel column are alternately connected to a first data line DL1 and a second data line DL2, e.g., the subpixel R11 is connected to the first data line DL1, the subpixel R21 is connected to the second data line DL2, the subpixel R31 is connected to the first data line DL1, and the subpixel R41 is connected to the second data line DL2. Additionally, for example, the subpixels G11, G21, G31, and G41 in a second subpixel column are alternately connected to the second data line DL2 and a third data line DL3, and the subpixels B11, B21, B31, and B41 in a third subpixel column are alternately connected to the third data line DL3 and a fourth data line DL4.

In more detail, the subpixel R11 in the first subpixel row and the first subpixel column is connected to the first data line DL1, the subpixel R21 in a second subpixel row and the first subpixel column is connected to the second data line DL2, the subpixel R31 in a third subpixel row and the first subpixel column is connected to the first data line DL1, and the subpixel R41 in a fourth subpixel row and the first subpixel column is connected to the second data line DL2.

In more detail, the subpixel G11 in the first subpixel row and the second subpixel column is connected to the second data line DL2, the subpixel G21 in the second subpixel row and the second subpixel column is connected to the third data line DL3, the subpixel G31 in the third subpixel row and the second subpixel column is connected to the second data line DL2, and the subpixel G41 in the fourth subpixel row and the second subpixel column is connected to third data line DL3. The connections of the subpixels B11, B21, B31, and B41 to the third data line DL3 and fourth data line DL4 may be similarly configured.

The polarities of the data voltages applied to the data lines may be inverted for each subsequent data line. For example, positive data voltages may be applied to the first data line DL1, negative data voltages may be applied to the second data line DL2, positive data voltages may be applied to the third data line DL3, and negative data voltages may be applied to the fourth data line DL4.

In addition, the polarities of the data voltages applied to the data lines may be inverted for each subsequent frame. For example, when positive data voltages are applied to the first data line DL1 during a first frame, negative data voltages may be applied to the first data line DL1 during a second frame, positive data voltages may be applied to the first data line DL1 during a third frame, negative data voltages may be applied to the first data line DL1 during a fourth frame, etc.

Therefore, the polarity of the display panel 100 alternates between positive and negative on a frame-by-frame basis, the polarities of the data lines are inverted with a column inversion method, and the polarities of the subpixels are inverted with a dot inversion method.

Figure 5A:
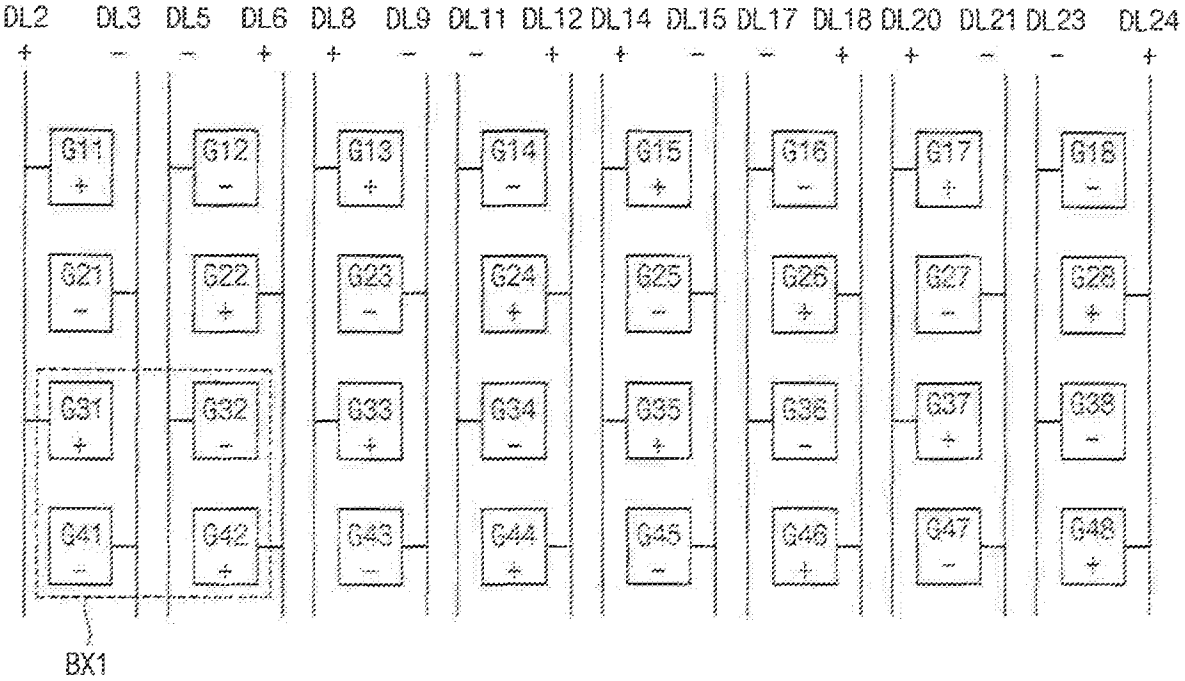
FIGS. 5A and 5B are diagrams illustrating an artifact that may be generated by overdriving the display panel of FIG. 1.
Figure 5B:
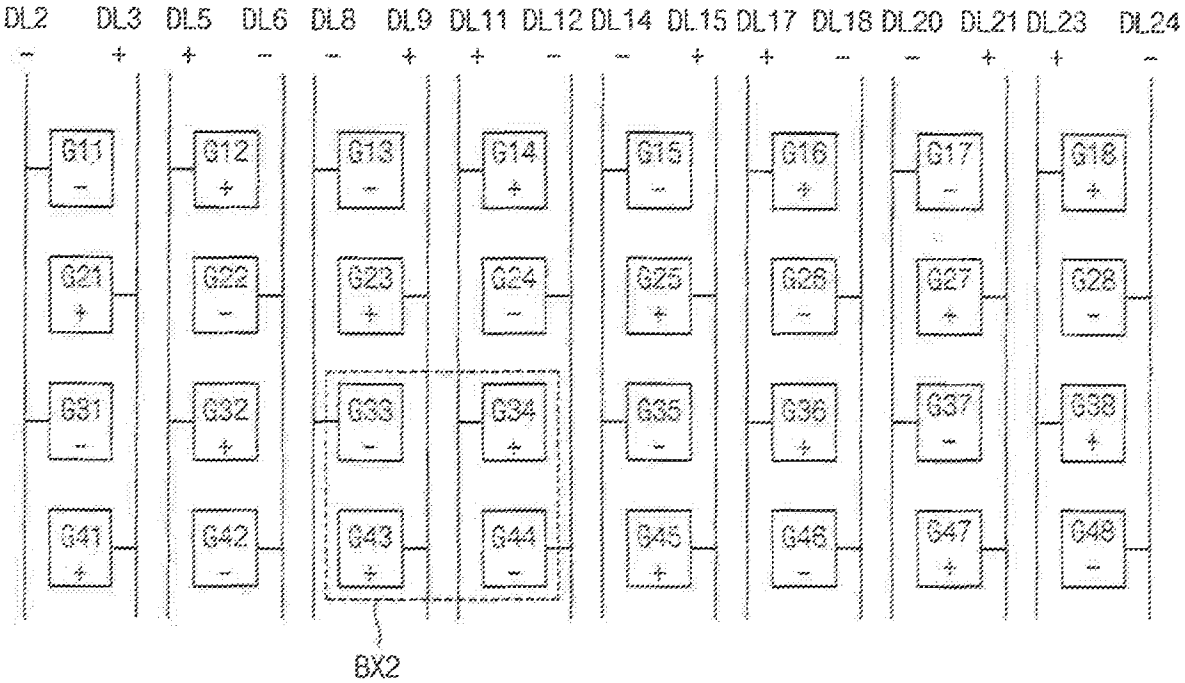
Figure 6:
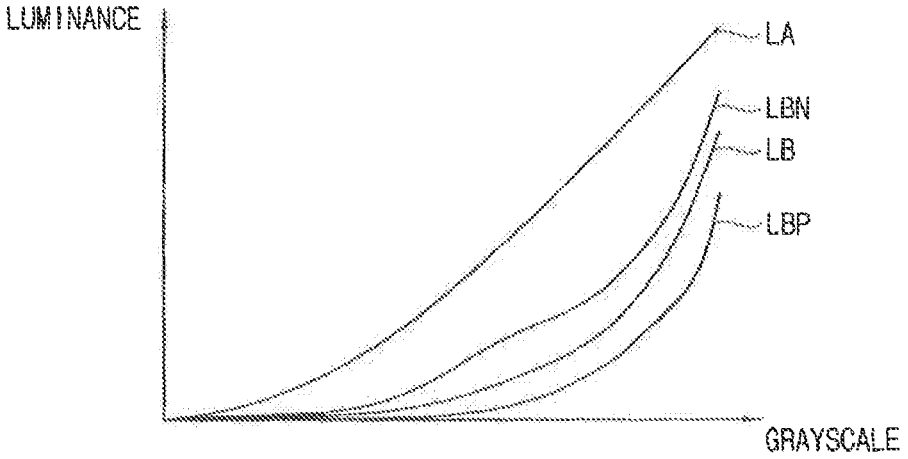
FIG. 6 is a graph for explaining the artifact that may be generated by overdriving the display panel of FIG. 1.

FIGS. 5A and 5B are diagrams illustrating an artifact that may be generated by overdriving the display panel of FIG. 1. FIG. 6 is a graph for explaining the artifact that may be generated by overdriving the display panel of FIG. 1.

In FIGS. 5A and 5B, only the green subpixels of the display panel 100 of FIG. 4 are illustrated for convenience of explanation. In addition, in FIGS. 5A and 5B, the gate lines are not illustrated for convenience of explanation.

The polarities of the pixel data of the display panel 100 in a first frame are illustrated in FIG. 5A. The polarities of the pixel data of the display panel 100 in a second frame are illustrated in FIG. 5B.

In FIG. 5A, a rectangular pattern BX1 that is two by two is located at the subpixels G31, G32, G41, and G42. An area within the rectangular pattern BX1 may represent an area with a relatively high luminance. In contrast, an area outside the rectangular pattern BX1 may represent an area with a relatively low luminance.

In FIG. 5B, a rectangular pattern BX2 that is two by two is located at the subpixels G33, G34, G43, and G44. An area within the rectangular pattern BX2 may represent an area with a relatively high luminance. In contrast, an area outside the rectangular pattern BX2 may represent an area with a relatively low luminance.

In FIG. 6, a first luminance curve LA represents luminances according to the grayscales when the difference between the target luminance of the previous frame and the target luminance of the present frame is not large. If the difference between the target luminance of the previous frame and the target luminance of the present frame is not large, the luminance is not significantly affected by the response speed of the liquid crystal and thus, the luminances in the first luminance curve LA are relatively high.

In contrast, a second luminance curve LB represents luminances according to the grayscales when the difference between the target luminance of the previous frame and the target luminance of the present frame is large. If the difference between the target luminance of the previous frame and the target luminance of the present frame is large, the luminance is affected by the response speed of the liquid crystal and thus, the luminances in the second luminance curve LB are relatively low. Therefore, when the difference between the target luminance of the previous frame and the target luminance of the present frame is large, the grayscale data may need to be compensated by the overdriving method, as described above.

A third luminance curve LBN represents luminances according to the grayscales when the difference between the target luminance of the previous frame and the target luminance of the present frame is large and the polarity of the present frame is negative. A fourth luminance curve LBP represents luminances according to the grayscales when the difference between the target luminance of the previous frame and the target luminance of the present frame is large and the polarity of the present frame is positive.

When the polarity of the present frame is negative, a gate-source voltage VGS of the switching transistor of the subpixel is greater than a gate-source voltage VGS of the switching transistor of the subpixel having positive polarity. The levels of the voltages of the gate electrode of the switching element in the positive polarity and in the negative polarity are substantially the same. However, the level of the voltage of the source electrode of the switching element in the negative polarity is less than the level of the voltage of the source electrode of the switching element in the positive polarity.

Thus, the turn on time of the switching element of the subpixel in the negative polarity is faster than the turn on time of the switching element of the subpixel in the positive polarity. As such, the luminance according to the grayscale in the negative polarity may be higher than the luminance according to the grayscale in the positive polarity.

When the overdriving method is performed using the same target grayscale in the positive polarity and in the negative polarity, the luminance of the pixel having negative polarity is higher than the luminance of the pixel having positive polarity. Due to the difference in the luminance, the display panel may display an artifact.

For example, the subpixel G33 in FIG. 5A (e.g., in the first frame) represents a low grayscale (e.g., black grayscale) and the subpixel G33 in FIG. 5B (e.g., in the second frame) represents a high grayscale (e.g., green grayscale). For example, the subpixel G44 in FIG. 5A (e.g., in the first frame) represents a low grayscale (e.g., black grayscale) and the subpixel G44 in FIG. 5B (e.g., in the second frame) represents a high grayscale (e.g., green grayscale). The polarity of the pixel data of the subpixels G33 and G44 is negative in the present frame (the second frame), as shown in FIG. 5B.

For example, the subpixel G34 in FIG. 5A (e.g., in the first frame) represents a low grayscale (e.g., black grayscale) and the subpixel G34 in FIG. 5B (e.g., in the second frame) represents a high grayscale (e.g., green grayscale). For example, the subpixel G43 in FIG. 5A (e.g., in the first frame) represents a low grayscale (e.g., black grayscale) and the subpixel G43 in FIG. 5B (e.g., in the second frame) represents a high grayscale (e.g., green grayscale). The polarity of the pixel data of the subpixels G34 and G43 is positive in the present frame (the second frame), as shown in FIG. 5B.

In the present frame (the second frame), the luminance of the subpixels G33 and G44 having negative polarity may be higher than the luminance of the subpixels G34 and G43 having positive polarity. Therefore, as the rectangular pattern BX1 in the previous frame (the first frame) moves to the rectangular pattern BX2 in the present frame (the second frame), a diagonal artifact may be generated at a boundary portion of the rectangular patterns BX1 and BX2.

Although an artifact generated by the moving rectangular pattern is explained with reference to FIGS. 5A and 5B, the inventive concept is not limited to the above explained artifact. For example, in general, when a positive subpixel and a negative subpixel are adjacent to each other, the difference of the grayscales is large in subsequent frames, and the positive subpixel and the negative subpixel are overdriven using the same target grayscale, the difference in luminance, as described above, between the positive subpixel and the negative subpixel may cause a display artifact to be generated.

Figure 7:
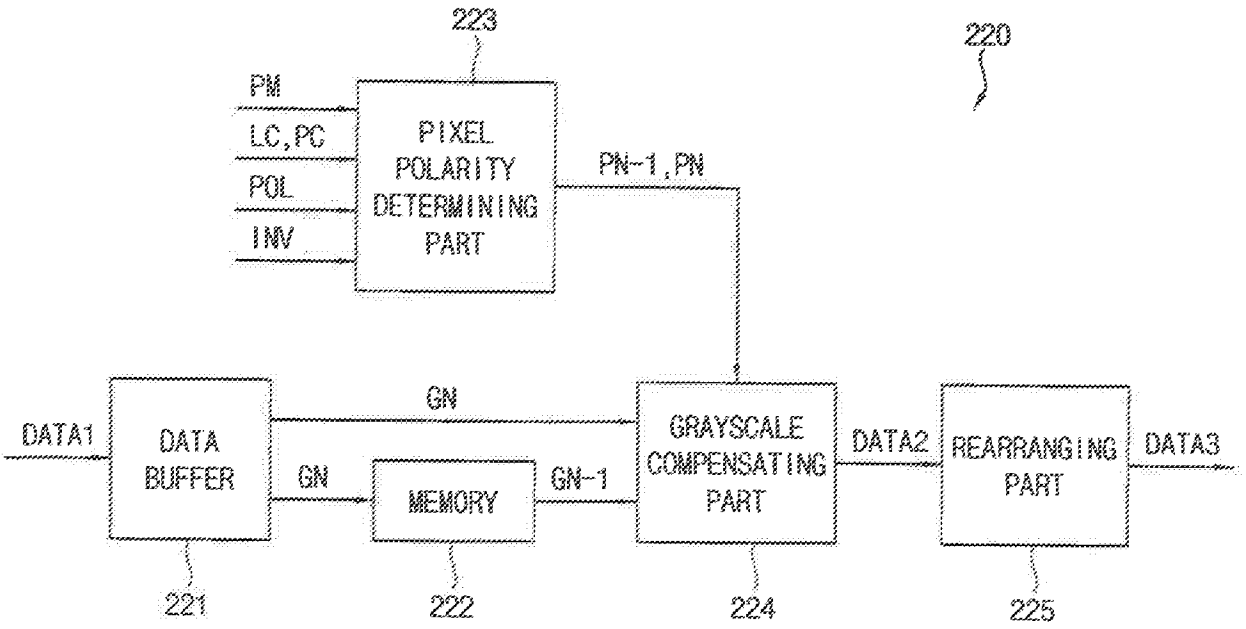
FIG. 7 is a block diagram illustrating a data processing part of FIG. 2 according to an exemplary embodiment of the inventive concept.
Figure 8:
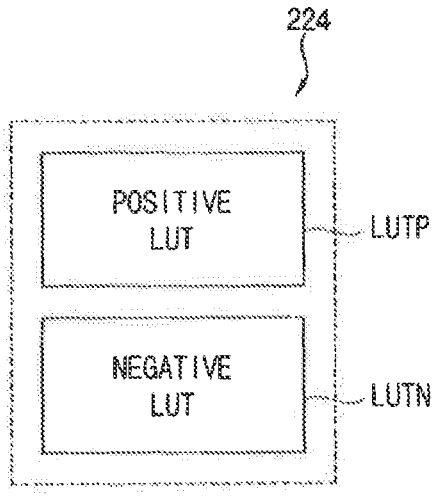
FIG. 8 is a block diagram illustrating a grayscale compensating part of FIG. 7 according to an exemplary embodiment of the inventive concept.
Figure 9:
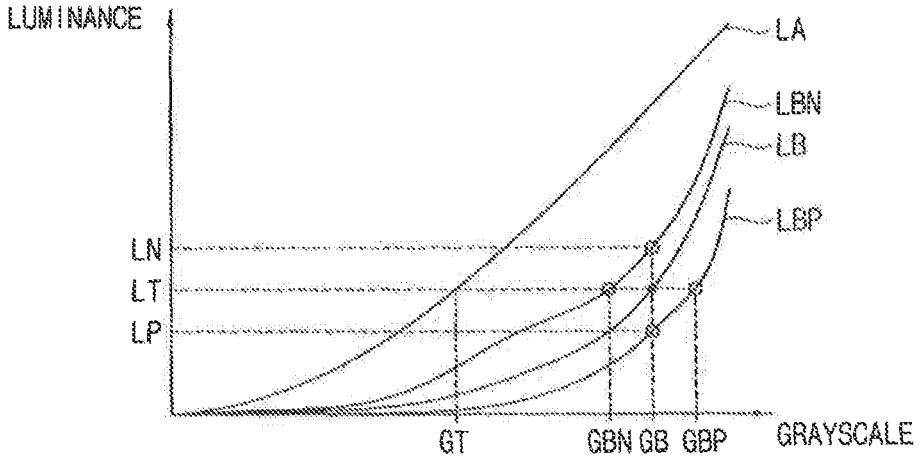
FIG. 9 is a graph illustrating an overdriving method of the grayscale compensating part of FIG. 7 according to an exemplary embodiment of the inventive concept.

FIG. 7 is a block diagram illustrating a data processing part of FIG. 2 according to an exemplary embodiment of the inventive concept. FIG. 8 is a block diagram illustrating a grayscale compensating part of FIG. 7 according to an exemplary embodiment of the inventive concept. FIG. 9 is a graph illustrating an overdriving method of the grayscale compensating part of FIG. 7 according to an exemplary embodiment of the inventive concept.

Referring to FIGS. 1 to 9, the data processing part 220 includes a pixel polarity determining part 223 and a grayscale compensating part 224. The data processing part 220 may further include a data buffer 221 and a memory 222. The data processing part 220 may further include a rearranging part 225.

The pixel polarity determining part 223 determines a polarity PN of the pixel data signal of the present frame.

The pixel polarity determining part 223 receives a pixel map PM which represents a structure of the pixel data of the present frame, a line count LC and a pixel count PC which represent a location in the pixel map PM and a polarity signal POL which represents polarities of all pixel data of the present frame.

The pixel map PM represents the pixel structure of the display panel 100. For example, the pixel map PM may include whether the display panel has an alternate structure or non-alternate structure for the data line. For example, the pixel map PM may include information on the location of a dummy line of the display panel 100.

The line count LC may indicate a row coordinate of the subpixel in the pixel map PM. The pixel count PC may indicate a column coordinate of the subpixel in the pixel map PM.

The polarity signal POI, indicates a phase of the polarity of the display panel 100. The polarity signal POL may represent whether the polarity of the display panel 100 has a first phase or a second phase that is opposite to the first phase. The polarity signal POL may be a one-bit signal.

For example, the subpixels of the display panel 100 having the polarities in FIG. 5A may be called the first phase. The subpixels of the display panel 100 having the polarities in FIG. 5B may be called the second phase.

The pixel polarity determining part 223 may determine the polarity PN of each pixel data of the present frame using the pixel map PM, the line count LC, the pixel count PC, and the polarity signal POL.

The pixel polarity determining part 223 may further determine a polarity PN−1 of the pixel data of the previous frame.

The pixel polarity determining part 223 may further receive an inverting mode signal INV to determine the polarity PN−1 of the pixel data of the previous frame.

The inverting mode signal INV may represent whether the display panel 100 is driven in a one-frame inverting mode or a two-frame inverting mode. The polarity PN−1 of the pixel data signal of the previous frame may be determined using the polarity PN of the pixel data signal of the present frame and the inverting mode signal INV.

The pixel polarity determining part 223 may determine the polarity PN and the polarity PN−1 using the pixel map PM, the line count LC, the pixel count PC, the polarity signal POL, and the inverting mode signal INV.

The data buffer 221 receives the input image data DATA1. The data buffer 221 buffers a pixel data signal GN of the present frame of the input image data DATA1 and outputs the pixel data signal GN to the memory 222 and the grayscale compensating part 224.

The memory 222 delays the pixel data signal GN of the present frame to generate a pixel data signal GN−1 of the previous frame. The memory 222 outputs the pixel data signal GN−1 of the previous frame to the grayscale compensating part 224. For example, the memory 222 may be a frame memory capable of storing the data signal of a single frame.

The grayscale compensating part 224 may generate a compensated grayscale DATA2 of the pixel data of the present frame based on the pixel data signal GN−1 of the previous frame, the pixel data GN of the present frame, and the polarity PN of the pixel data signal GN of the present frame. The compensated grayscale DATA2 varies according to the polarity PN of the pixel data signal GN of the present frame.

For example, the grayscale compensating part 224 may generate the compensated grayscale DATA2, which is relatively high, when the difference between the pixel data signal GN−1 of the previous frame and the pixel data signal GN of the present frame is relatively large.

For example, the grayscale compensating part 224 generates a compensated grayscale for a negative subpixel when the polarity PN is negative. Herein, the compensated grayscale for the negative subpixel may be an absolute value so that the compensated grayscale for the negative subpixel does not have negative values. Conversely, the grayscale compensating part 224 generates a compensated grayscale for a positive subpixel when the polarity PN is positive. The compensated grayscale for the negative subpixel may be less than the compensated grayscale for the positive subpixel if the other conditions (e.g., the grayscale of the pixel data signal of the previous frame and the grayscale of the pixel data signal of the present frame) are substantially the same. As shown in FIG. 6, when the same grayscale is applied to the negative subpixel and the positive subpixel under the same conditions, the luminance of the negative subpixel is less than the luminance of the positive subpixel and thus, the compensated grayscale for the negative subpixel may be set to be less than the compensated grayscale for the positive subpixel. As a result, the luminance of the negative subpixel may be substantially the same as the luminance of the positive subpixel.

The compensated grayscale for the negative subpixel and the compensated grayscale for the positive subpixel may be generated according to the luminance graph shown in FIG. 9. The luminance of the display panel 100 may be measured to generate the luminance graph of FIG. 9.

Referring to FIG. 9, in a conventional overdriving method, when the difference between the luminance of the previous frame and the present frame is large, both the positive grayscale data and the negative grayscale data are set to a boosted grayscale GB corresponding to a target luminance LT. When the boosted grayscale GB is applied to the positive subpixel, a luminance LP of the positive subpixel is less than the target luminance IT. In contrast, when the boosted grayscale GB is applied to the negative subpixel, a luminance LN of the negative subpixel is greater than the target luminance LT.

On the other hand, in the overdriving method according to the present exemplary embodiment, when the difference between the luminance of the previous frame and the present frame is large, the positive grayscale data is set to a boosted grayscale GBP for the positive subpixel to correspond to the target luminance LT and the negative grayscale data is set to a boosted grayscale GBN for the negative subpixel to correspond to the target luminance LT.

When the boosted grayscale GBP is applied to the positive subpixel, the luminance of the positive subpixel may be the target luminance LT. In addition, when the boosted grayscale GBN is applied to the negative subpixel, the luminance of the negative subpixel may be the target luminance LT.

Referring to FIG. 8, for example, the grayscale compensating part 224 may include a positive lookup table LUTP storing the compensated grayscale for the positive subpixel and a negative lookup table LUTN storing the compensated grayscale for the negative subpixel.

For example, when the polarity of the display panel 100 alternates between positive and negative on a frame-by-frame basis, the positive lookup table LUTP may be called a negative to positive lookup table and the negative lookup table LUTN may be called a positive to negative lookup table.

Referring back to FIG. 7, the rearranging part 225 rearranges the compensated grayscale data DATA2 to correspond to a format of the data driver 500 and generates the data signal DATA3. The rearranging part 225 outputs the data signal DATA3 to the data driver 500.

According to the present exemplary embodiment, the grayscale compensating part 224 generates the compensated grayscale that varies according to the polarity of the pixel data signal of the present frame, so that the subpixels having the positive polarity and the negative polarity may have the target luminance LT. Thus, the artifact, caused by the polarity of the pixel data and the difference in luminance of the subpixels of the display panel, may be prevented. As such, the display quality of the display panel may be increased.

Figure 10:
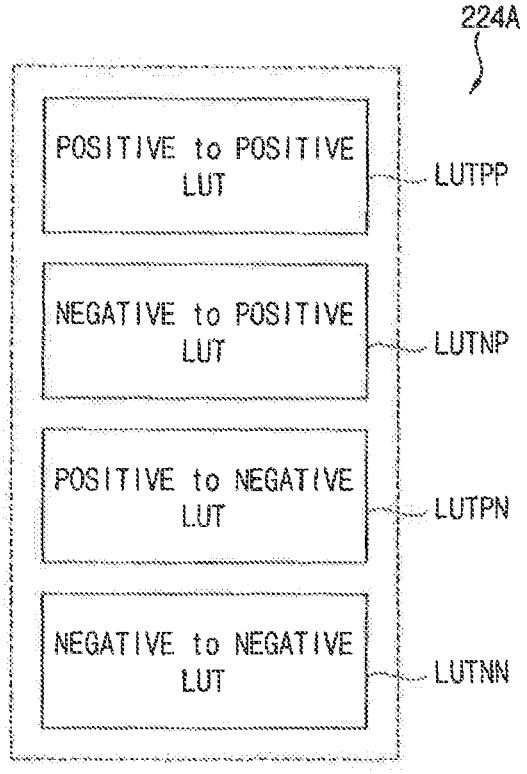
FIG. 10 is a block diagram illustrating a grayscale compensating part of a display apparatus according to an exemplary embodiment of the inventive concept.
Figure 11:
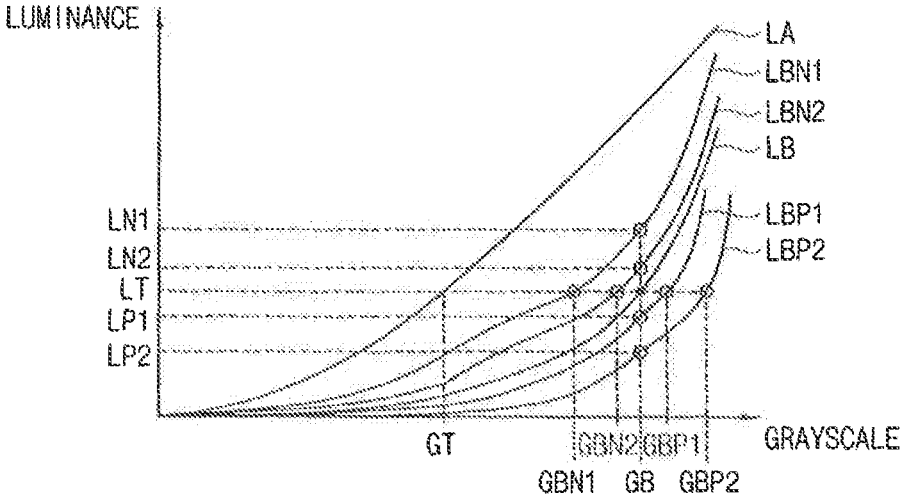
FIG. 11 is a graph illustrating an overdriving method of the grayscale compensating part of FIG. 10 according to an exemplary embodiment of the inventive concept.

FIG. 10 is a block diagram illustrating a grayscale compensating part of a display apparatus according to an exemplary embodiment of the inventive concept. FIG. 11 is a graph illustrating an overdriving method of the grayscale compensating part of FIG. 10 according to an exemplary embodiment of the inventive concept.

With respect to FIGS. 10 and 11, the method of driving the display panel and the display apparatus is substantially the same as those described with reference to FIGS. 1 to 9, except for the grayscale compensating part. Thus, descriptions of similar elements may be omitted.

Referring to FIGS. 1 to 7, 10 and 11, the display apparatus includes the display panel 100 and the panel driver. The panel driver includes the timing controller 200, the gate driver 300, the gamma reference voltage generator 400 and the data driver 500.

The timing controller 200 includes the data processing part 220 and the signal generating part 240.

In the present exemplary embodiment, the data processing part 220 includes the pixel polarity determining part 223 and a grayscale compensating part 224A. The data processing part 220 may further include the data buffer 221 and the memory 222. The data processing part 220 may further include the rearranging part 225.

In the present exemplary embodiment, as described with reference to FIG. 7, the pixel polarity determining part 223 determines the polarity PN−1 of the pixel data signal of the previous frame and the polarity PN of the pixel data signal of the present frame.

The pixel polarity determining part 223 may determine the polarity PN and the polarity PN−1 using the pixel map PM, the line count LC, the pixel count PC, the polarity signal POL, and the inverting mode signal INV.

Referring to FIGS. 10 and 11, the grayscale compensating part 224A may generate the compensated grayscale DATA2 of the pixel data of the present frame based on the pixel data signal GN−1 of the previous frame, the pixel data GN of the present frame, the polarity PN−1 of the pixel data signal GN−1 of the previous frame, and the polarity PN of the pixel data signal GN of the present frame. The compensated grayscale DATA2 varies according to the polarity PN−1 and the polarity PN.

For example, the grayscale compensating part 224A generates a compensated grayscale for a negative subpixel when the polarity PN is negative. Herein, the compensated grayscale for the negative subpixel may be an absolute value so that the compensated grayscale for the negative subpixel does not have negative values. The grayscale compensating part 224A generates a compensated grayscale for a positive subpixel when the polarity PN is positive. The compensated grayscale for the negative subpixel may be less than the compensated grayscale for the positive subpixel if the other conditions (e.g. the grayscale of the pixel data signal of the previous frame and the grayscale of the pixel data signal of the present frame) are substantially the same.

Furthermore, the grayscale compensating part 224A generates a negative to negative compensated grayscale GBN1 when the polarity PN−1 is negative and the polarity PN is negative. The grayscale compensating part 224A generates a positive to negative compensated grayscale GBN2 when the polarity PN−1 is positive and the polarity PN is negative. The negative to negative compensated grayscale GBN1 may be less than the positive to negative compensated grayscale GBN2 if the other conditions (e.g., the grayscale of the pixel data signal of the previous frame and the grayscale of the pixel data signal of the present frame) are substantially the same.

In substantially the same conditions, a difference between the data voltage from the positive polarity to the negative polarity is greater than a difference between the data voltage from the negative polarity to the negative polarity. Thus, the data voltage from the negative polarity to the negative polarity may be charged faster than the data voltage from the positive polarity to the negative polarity. As a result, a luminance LBN1 of the pixel having the data voltage from the negative polarity to the negative polarity is greater than a luminance LBN2 of the pixel having the data voltage from the positive polarity to the negative polarity. As such, the negative to negative compensated grayscale GBN1 may be less than the positive to negative compensated grayscale GBN2.

Additionally, the grayscale compensating part 224A generates a negative to positive compensated grayscale GBP2 when the polarity PN−1 is negative and the polarity PN is positive. The grayscale compensating part 224A generates a positive to positive compensated grayscale GBP1 when the polarity PN−1 is positive and the polarity PN is positive. The negative to positive compensated grayscale GBP2 may be greater than the positive to positive compensated grayscale GBP1 if the other conditions (e.g., the grayscale of the pixel data signal of the previous frame and the grayscale of the pixel data signal of the present frame) are substantially the same.

In substantially the same conditions, a difference between the data voltage from the negative polarity to the positive polarity is greater than a difference between the data voltage from the positive polarity to the positive polarity. Thus, the data voltage from the positive polarity to the positive polarity may be charged faster than the data voltage from the negative polarity to the positive polarity. As a result, a luminance LBP1 of the pixel having the data voltage from the positive polarity to the positive polarity is greater than a luminance LBP2 of the pixel having the data voltage from the negative polarity to the positive polarity. As such, the negative to positive compensated grayscale GBP2 may be greater than the positive to positive compensated grayscale GBP1.

In the overdriving method according to the present exemplary embodiment, when the difference in luminance between the previous frame and the present frame is large, the grayscale data is set based on the polarities of the previous frame and the present frame. When the polarity of the pixel of the previous frame is negative and the polarity of the pixel of the present frame is negative, the grayscale data is set to the negative to negative boosted grayscale GBN1 to correspond to the target luminance LT of the target grayscale GT. When the polarity of the pixel of the previous frame is positive and the polarity of the pixel of the present frame is negative, the grayscale data is set to the positive to negative boosted grayscale GBN2 to correspond to the target luminance LT of the target grayscale GT. When the polarity of the pixel of the previous frame is positive and the polarity of the pixel of the present frame is positive, the grayscale data is set to the positive to positive boosted grayscale GBP1 to correspond to the target luminance LT of the target grayscale GT. When the polarity of the pixel of the previous frame is negative and the polarity of the pixel of the present frame is positive, the grayscale data is set to the negative to positive boosted grayscale GBP2 to correspond to the target luminance LT of the target grayscale GT.

When the boosted grayscales GBP1 and GBP2 for the positive subpixel are applied to the positive subpixel, the luminance of the positive subpixel may have the target luminance LT. In addition, when the boosted grayscales GBN1 and GBN2 for the negative subpixel are applied to the negative subpixel, the luminance of the negative subpixel may have the target luminance LT.

Referring to FIG. 10, the grayscale compensating part 224A may include a first lookup table LUTPP storing the positive to positive compensated grayscale, a second lookup table LUTNP storing the negative to positive compensated grayscale, a third lookup table LUTPN storing the positive to negative compensated grayscale, and a fourth lookup table LUTNN storing the negative to negative compensated grayscale.

According to the present exemplary embodiment, the grayscale compensating part 224A generates the compensated grayscale that varies according to the polarity of the pixel data signal of the previous frame and the polarity of the pixel data signal of the present frame and thus, the subpixels may have the target luminance LT when the polarity of the pixel data signal of the previous frame and the polarity of the pixel data signal of the present frame are different from each other. As a result, the artifact, caused by the polarity of the pixel data and the difference in luminance of the subpixels of the display panel, may be prevented, and the display quality of the display panel may be increased.

Figure 12:
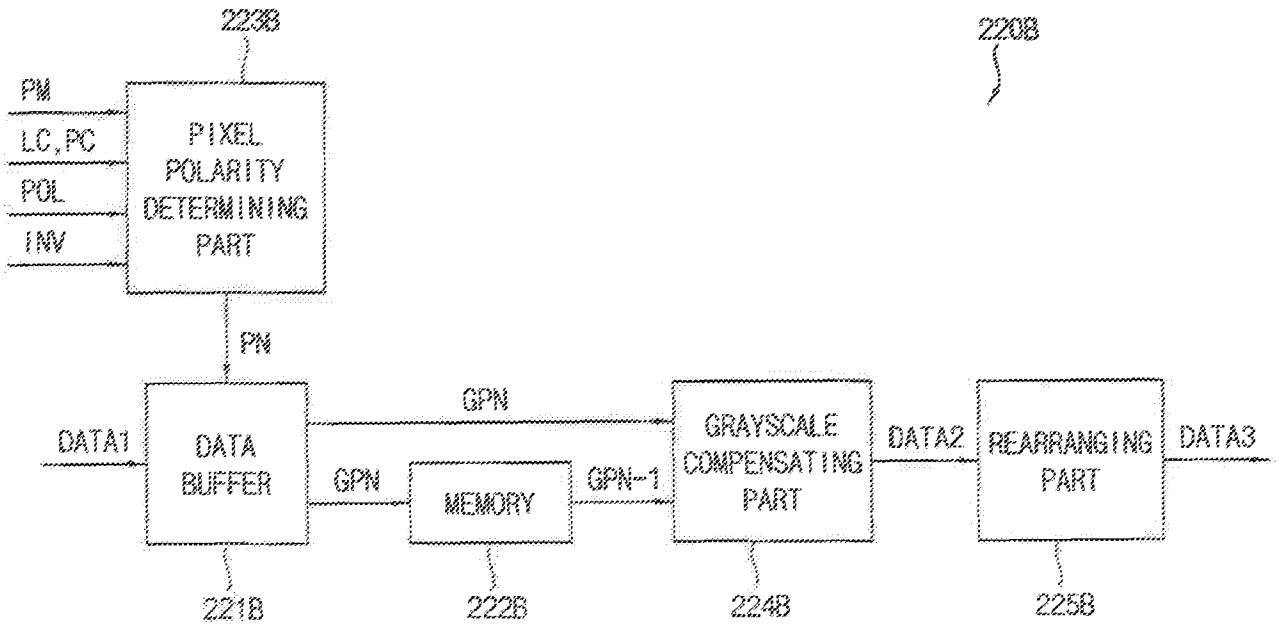
FIG. 12 is a block diagram illustrating a data processing part of a display apparatus according to an exemplary embodiment of the inventive concept.

FIG. 12 is a block diagram illustrating a data processing part of a display apparatus according to an exemplary embodiment of the inventive concept.

With respect to FIG. 12, the method of driving the display panel and the display apparatus is substantially the same as those described with reference to FIGS. 1 to 9, except for the data processing part. Thus, descriptions of similar elements may be omitted.

Referring to FIGS. 1 to 12, the display apparatus includes the display panel 100 and the panel driver. The panel driver includes the timing controller 200, the gate driver 300, the gamma reference voltage generator 400, and the data driver 500.

In the present exemplary embodiment, the timing controller 200 includes a data processing part 220B and the signal generating part 240.

The data processing part 220B includes a pixel polarity determining part 223B and a grayscale compensating part 224B. The data processing part 220B may further include a data buffer 221B and a memory 222B. The data processing part 220B may further include a rearranging part 225B.

The pixel determining part 223B determines the polarity PN of the pixel data signal of the present frame.

The pixel determining part 223B receives the pixel map PM that represents a structure of the pixel data of the present frame, the line count LC and pixel count PC that represent a location in the pixel map PM, and the polarity signal POL that represents polarities of all pixel data of the present frame.

The pixel polarity determining part 223B may determine the polarity PN of each pixel data of the present frame using the pixel map PM, the line count LC, the pixel count PC, and the polarity signal POL.

In the present exemplary embodiment, the pixel polarity determining part 223B outputs the polarity PN of each pixel data signal of the present frame to the data buffer 221B.

In the present exemplary embodiment, the data buffer 221B receives the input image data DATA1. The data buffer 221B1 merges the polarity PN of the pixel data signal of the present frame and the pixel data signal GN of the present frame to generate a pixel data-polarity merged signal GPN of the present frame. The data buffer 221B buffers the pixel data-polarity merged signal GPN of the present frame and outputs the pixel data-polarity merged signal GPN of the present frame to the memory 222B and the grayscale compensating part 224B.

The memory 222B delays the pixel data-polarity merged signal GPN of the present frame to generate a pixel data-polarity merged signal GPN−1 of the previous frame. The memory 222B outputs the pixel data-polarity merged signal GPN−1 of the previous frame to the grayscale compensating part 224B.

The grayscale compensating part 224B may extract the polarity PN of the pixel data signal of the present frame from the pixel data-polarity merged signal GPN of the present frame. According to an exemplary embodiment of the inventive concept, the grayscale compensating part 224B may extract the polarity PN−1 of the pixel data signal of the previous frame from the pixel data-polarity merged signal GPN−1 of the previous frame.

The grayscale compensating part 224B may generate the compensated grayscale DATA2 of the pixel data of the present frame based on the pixel data-polarity merged signal GPN−1 of the previous frame and the pixel data-polarity merged signal GPN of the present frame. In other words, using the pixel data-polarity merged signal GPN−1 and the pixel data-polarity merged signal GPN of the present frame, the grayscale compensating part 224B may generate the compensated grayscale DATA2 based on the pixel data signal GN−1 of the previous frame, the pixel data GN of the present frame, and the polarity PN. According to an exemplary embodiment of the inventive concept, generation of the compensated grayscale DATA2 may be further based on the polarity PN−1.

The compensated grayscale DATA2 may vary according to the polarity PN, as described with reference to FIG. 7. According to an exemplary embodiment of the inventive concept, the compensated grayscale DATA2 may vary according to the polarity PN−1 and the polarity PN, as described with reference to FIG. 10.

According to the present exemplary embodiment, the grayscale compensating part 224B generates the compensated grayscale that varies according to the polarity of the pixel data signal of the present frame so that the subpixels may have the target luminance LT. Thus, the artifact, caused by the polarity of the pixel data and the difference in luminance of the subpixels of the display panel, may be prevented. As such, the display quality of the display panel may be improved.

According to the present exemplary embodiment, the artifact, caused by the polarity of the pixel data and the difference in luminance of the subpixels of the display panel, may be prevented so that the display quality of the display panel may be increased.

According to the method of driving the display panel and the display apparatus for performing the method, as described above, a compensated grayscale that varies according to the polarity of the pixel data of the present frame is generated and the display image is compensated based on the compensated grayscale. As such, the difference in luminance of the display panel caused by the polarity of the pixel data may be minimized, and the display quality of the display panel may be increased.

While the inventive concept has been shown and described with reference to the exemplary embodiments thereof, it will be understood by those of ordinary skill in the art that various changes in form and details may be made thereto without departing from the spirit and scope of the present inventive concept as defined by the following claims.

What is claimed is:

1. A method of driving a display panel, the method comprising:

determining a present polarity of a pixel data signal of a present frame;

generating a first compensated grayscale of the pixel data signal of the present frame using a pixel data signal of a previous frame, the pixel data signal of the present frame, and the present polarity, wherein the first compensated grayscale varies according to the present polarity;

displaying an image using the first compensated grayscale;

merging the present polarity with the pixel data signal of the present frame generate a merged signal of the present frame; and extracting the present polarity from the merged signal of the present frame.

2. The method of claim 1, wherein a compensated grayscale for a negative subpixel when the present polarity is negative is less than a compensated grayscale for a positive subpixel when the present polarity is positive.

3. The method of claim 2, wherein the first compensated grayscale is generated using a first lookup table storing the compensated grayscale for the negative subpixel and a second lookup table storing the compensated grayscale for the positive subpixel.

4. The method of claim 1, wherein the present polarity is determined using a pixel map that represents a structure of pixel data of the present frame, a line count and a pixel count that represent a location in the pixel map, and a polarity signal that represents polarities of all the pixel data of the present frame.

5. A display apparatus comprising:

a pixel polarity determining circuit configured to determine a present polarity of a pixel data signal of a present frame;

a grayscale compensating circuit configured to generate a first compensated grayscale of the pixel data signal of the present frame by using a pixel data signal of a previous frame, the pixel data signal of the present frame, and the present polarity, wherein the first compensated grayscale varies according to the present polarity; and a display panel configured to display an image using the first compensated grayscale, wherein the pixel polarity determining circuit is configured to output the present polarity to a data buffer, the data buffer is configured to merge the present polarity with the pixel data signal of the present frame to generate a merged signal of the present frame; and the grayscale compensating circuit is configured to extract the present polarity from the merged signal of the present frame.

6. The display apparatus of claim 5, further comprising:

a memory configured to delay the merged; signal of the present frame to generate a merged data signal of the previous frame and to output the merged data signal of the previous frame to the grayscale compensating circuit.

7. The display apparatus of claim 5, wherein the grayscale compensating circuit is configured to generate a compensated grayscale for a negative subpixel when the present polarity is negative and a compensated grayscale for a positive subpixel when the present polarity is positive, and the compensated grayscale for the negative subpixel is less than the compensated grayscale for the positive subpixel.

8. The display apparatus of claim 7, wherein the grayscale compensating circuit comprises:

a first lookup table storing the compensated grayscale for the negative subpixel; and a second lookup table storing the compensated grayscale for the positive subpixel.

9. The display apparatus of claim 5, wherein the pixel polarity determining circuit is configured to determine the present polarity using a pixel map that represents a structure of pixel data of the present frame, a line count and a pixel count that represent a location in the pixel map, and a polarity signal that represents polarities of all the pixel data of the present frame.

10. A method of driving a display panel, the method comprising:

determining a present polarity of a pixel data signal of a present frame;

merging the present polarity with the pixel data signal of the present frame to generate a first merged signal of the present frame;

delaying the first merged signal to generate a second merged signal of a previous frame;

extracting the present polarity from the first merged signal;

extracting a previous polarity of a pixel data signal of the previous frame from the second merged signal; and generating a first compensated grayscale using the pixel data signal of the previous frame, the pixel data signal of the present frame, the previous polarity, and the present polarity, wherein the first compensated grayscale varies according to the previous polarity and the present polarity.

11. The method of claim 10, Wherein a compensated grayscale for a negative subpixel when the present polarity is negative is less than a compensated grayscale for a positive subpixel when the present polarity is positive.

12. The method of claim 11, wherein the first compensated grayscale is generated using a first lookup table storing the compensated grayscale for the negative subpixel and a second lookup table storing the compensated grayscale for the positive subpixel.

13. The method of claim 10, wherein the present polarity is determined using a pixel map that represents a structure of pixel data of the present frame, a line count and a pixel count that represent a location in the pixel map, and a polarity signal that represents polarities of all the pixel data of the present frame.

* * * * *